US009224527B2

(12) United States Patent
Ohta et al.

(10) Patent No.: US 9,224,527 B2
(45) Date of Patent: Dec. 29, 2015

(54) PRODUCTION METHOD OF ULTRAFINE CRYSTALLINE ALLOY RIBBON

(71) Applicant: HITACHI METALS, LTD., Minato-ku, Tokyo (JP)

(72) Inventors: Motoki Ohta, Mishima-gun (JP); Yoshihito Yoshizawa, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/367,122

(22) PCT Filed: Dec. 20, 2012

(86) PCT No.: PCT/JP2012/083093
§ 371 (c)(1),
(2) Date: Jun. 19, 2014

(87) PCT Pub. No.: WO2013/094690
PCT Pub. Date: Jun. 27, 2013

(65) Prior Publication Data

US 2015/0000862 A1 Jan. 1, 2015

(30) Foreign Application Priority Data

Dec. 20, 2011 (JP) ..... 2011-277894

(51) Int. Cl.
*B22D 11/00* (2006.01)
*B22D 11/06* (2006.01)
(Continued)

(52) U.S. Cl.
CPC ..... *H01F 1/14766* (2013.01); *B22D 11/06* (2013.01); *B22D 11/0611* (2013.01); *B22D 11/0682* (2013.01); *B22D 27/04* (2013.01); *B22D 27/045* (2013.01); *C22C 33/003* (2013.01); *C22C 38/00* (2013.01); *C22C 38/002* (2013.01); *C22C 38/02* (2013.01);
(Continued)

(58) Field of Classification Search
CPC ..... B22D 11/0682; B22D 11/06; B22D 11/0611; B22D 11/001; B22D 27/045; B22D 27/04
See application file for complete search history.

(56) References Cited

U.S. PATENT DOCUMENTS 6,405,787 B2 6/2002 Bizen et al.
8,177,923 B2 5/2012 Ohta et al.
(Continued)

FOREIGN PATENT DOCUMENTS

JP 07-266006 A 10/1995
JP 2001-191151 A 7/2001
(Continued)

*Primary Examiner* — Kevin P Kerns
*Assistant Examiner* — Steven Ha
(74) *Attorney, Agent, or Firm* — Sughrue Mion, PLLC

(57) ABSTRACT

A method for producing an ultrafine-crystalline alloy ribbon having a structure in which crystal grains having an average grain size of 1-30 nm are dispersed at a ratio of 5-30% by volume in an amorphous matrix ultrafine, comprising the steps of ejecting an alloy melt onto a rotating cooling roll to quench it; forming an easily windable ribbon having such toughness that it is not fractured when bent to a bending radius of 1 mm or less, before the start of winding around a reel; and changing the forming conditions of the ribbon after the start of winding around a reel, to obtain a structure in which ultrafine crystal grains having an average grain size of 1-30 nm are dispersed at a ratio of 5-30% by volume in an amorphous matrix.

6 Claims, 1 Drawing Sheet

(51) Int. Cl.

| | |
|---|---|
| ***H01F 1/147*** | (2006.01) |
| ***B22D 27/04*** | (2006.01) |
| ***C22C 38/00*** | (2006.01) |
| ***C22C 45/02*** | (2006.01) |
| ***C22C 33/00*** | (2006.01) |
| ***H01F 1/153*** | (2006.01) |
| ***C22C 38/02*** | (2006.01) |
| ***C22C 38/08*** | (2006.01) |
| ***C22C 38/16*** | (2006.01) |

(52) U.S. Cl.

CPC ..... *C22C 38/08* (2013.01); *C22C 38/16* (2013.01); *C22C 45/02* (2013.01); *H01F 1/14708* (2013.01); *H01F 1/15308* (2013.01); *B22D 11/001* (2013.01)

(56) References Cited

U.S. PATENT DOCUMENTS

| | | | | |
|---|---|---|---|---|
| 8,182,620 | B2 | 5/2012 | Ohta et al. | |
| 8,287,666 | B2 | 10/2012 | Ohta et al. | |
| 2001/0006100 | A1 | 7/2001 | Bizen et al. | |
| 2009/0266448 | A1 | 10/2009 | Ohta et al. | |
| 2011/0085931 | A1 | 4/2011 | Ohta et al. | |
| 2011/0108167 | A1 | 5/2011 | Ohta et al. | |
| 2012/0318412 | A1 * | 12/2012 | Ohta et al. | 148/548 |

FOREIGN PATENT DOCUMENTS

| | | | |
|---|---|---|---|
| WO | 2007-032531 | A1 | 3/2007 |
| WO | 2011/122589 | A1 | 10/2011 |
| WO | WO 2011122589 | A1 * | 10/2011 |

* cited by examiner

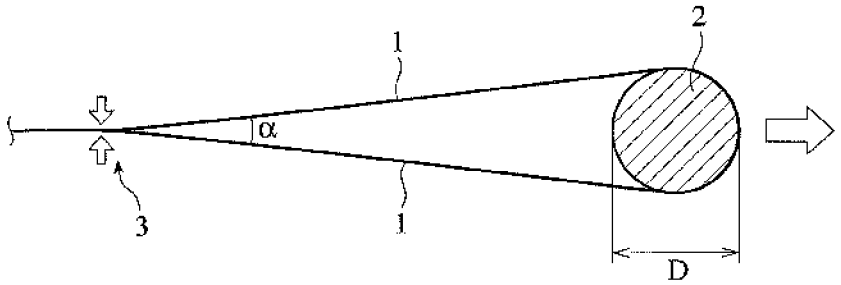
1
2
α
3
1
D

PRODUCTION METHOD OF ULTRAFINE CRYSTALLINE ALLOY RIBBON

CROSS REFERENCE TO RELATED APPLICATIONS

This application is a National Stage of International Application No. PCT/JP2012/083093 filed Dec. 20, 2012 (claiming priority based on Japanese Patent Application No. 2011-277894 filed Dec. 20, 2011), the contents of which are incorporated herein by reference in their entirety.

FIELD OF THE INVENTION

The present invention relates to a method for producing an ultrafine-crystalline alloy ribbon, which is an intermediate product for the production of a fine-crystalline, soft-magnetic alloy having a high saturation magnetic flux density and excellent soft-magnetic properties, suitable for various magnetic devices.

BACKGROUND OF THE INVENTION

Soft-magnetic materials used for various reactors, choke coils, pulse power magnetic devices, transformers, antennas, cores of motors, power generators, etc., current sensors, magnetic sensors, electromagnetic wave-absorbing sheets, etc. include silicon steel, ferrite, Co-based, amorphous, soft-magnetic alloys, Fe-based, amorphous, soft-magnetic alloys and Fe-based, fine-crystalline, soft-magnetic alloys. Though silicon steel is inexpensive and has a high magnetic flux density, it suffers large loss at high frequencies, and is difficult to be made thin. Because ferrite has a low saturation magnetic flux density, it is easily saturated magnetically in high-power applications with large operation magnetic flux densities. Because the Co-based, amorphous, soft-magnetic alloys are expensive and have as low saturation magnetic flux densities as 1 T or less, parts made of them for high-power applications are inevitably large, and their loss increases with time due to thermal instability. The Fe-based, amorphous, soft-magnetic alloys have still as low saturation magnetic flux densities as about 1.5 T, and their coercivity is not sufficiently low. The Fe-based, fine-crystalline, soft-magnetic alloys have higher saturation magnetic flux densities and lower coercivity than those of these soft-magnetic materials.

WO 2007/032531 discloses one example of such Fe-based, fine-crystalline, soft-magnetic alloys. This Fe-based, fine-crystalline, soft-magnetic alloy has a composition represented by the general formula of $Fe_{100-x-y-z}Cu_xB_yX_z$, wherein X is at least one element selected from the group consisting of Si, S, C, P, Al, Ge, Ga and Be, and x, y and z are numbers (atomic %) meeting the conditions of $0.1 \le x \le 3$, $10 \le y \le 20$, $0 < z \le 10$, and $10 < y+z \le 24$, and a structure in which 30% or more by volume of crystal grains having diameters of 60 nm or less are dispersed in an amorphous matrix, thereby having as high a saturation magnetic flux density as 1.7 T or more and low coercivity. This Fe-based, fine-crystalline, soft-magnetic alloy is produced by quenching an Fe-based alloy melt to form an ultrafine-crystalline alloy ribbon comprising fine crystal grains having an average grain size of 30 nm or less dispersed at a ratio of less than 30% by volume in an amorphous phase, and subjecting this ultrafine-crystalline alloy ribbon to a high-temperature, short-time heat treatment or a low-temperature, long-time heat treatment. The first produced ultrafine-crystalline alloy ribbon has ultrafine crystal grains acting as nuclei for a fine-crystalline structure of an Fe-based, fine-crystalline, soft-magnetic alloy, thereby having low toughness and being difficult to handle.

Amorphous alloy ribbons are generally produced by a liquid-quenching method using a single-roll apparatus, and the ribbon solidified by quenching is continuously wound as it is by a winding apparatus. Winding methods include, for example, a method of adhering the ribbon stripped from a roll to a winding reel with an adhesive tape, and then winding it, as described in JP 2001-191151 A.

Investigation on the stable mass production of the ultrafine-crystalline alloy ribbon of WO 2007/032531 has revealed that it suffers a problem which would not be encountered in the production of conventional amorphous alloy ribbons, namely, a problem of fracture occurring when the ribbon is wound. In the production of an ultrafine-crystalline alloy ribbon, the ultrafine-crystalline alloy ribbon is stripped from a cooling roll by blowing an inert gas (nitrogen, etc.) into a gap between the quenched ultrafine-crystalline alloy ribbon and the cooling roll, and an end of the ultrafine-crystalline alloy ribbon flying in the air is wound around a rotating reel. However, because an object wound by the conventional method is an amorphous alloy ribbon having high toughness and so resistant to fracture, the conventional method is not suitable for winding an ultrafine-crystalline alloy ribbon easily broken because of low toughness. Particularly, when the ribbon is fixed with an adhesive tape as described in JP 2001-191151 A, the ribbon should have excellent twisting stress resistance and shock resistance, because the ribbon flying from a cooling roll is wound around a rotating reel at as high a speed as 30 m/s. However, when stress such as shock is applied to an ultrafine-crystalline alloy ribbon in which large numbers of ultrafine crystal grains are precipitated, the ultrafine crystal grains likely act as stress-concentrated sites, causing fracture. Thus, the ultrafine-crystalline alloy ribbon, to which the present invention is applicable, is easily broken because of low toughness, suffering poor windability.

WO 2011/122589 discloses a primary ultrafine-crystalline alloy having a composition represented by the general formula of $Fe_{100-x-y-z}A_xB_yX_z$, wherein A is Cu and/or Au, X is at least one element selected from the group consisting of Si, S, C, P, Al, Ge, Ga and Be, and x, y and z are respectively numbers (atomic %) meeting the conditions of $0<x\le5$, $10\le y\le22$, $0\le z\le10$, and $x+y+z\le25$, and a structure in which primary ultrafine crystal grains having an average grain size of 30 nm or less are dispersed at a ratio of 5-30% by volume in an amorphous matrix, its differential scanning calorimetry (DSC) curve having a first exothermic peak and a second exothermic peak smaller than the first exothermic peak between a crystallization start temperature $T_{X1}$ and a compound-precipitating temperature $T_{X3}$, and the calorific value of the second exothermic peak being 3% or less of the total calorific value of the first and second exothermic peaks. In WO 2011/122589, however, the fracture of the primary ultrafine-crystalline alloy ribbon at the start of winding is not considered.

OBJECT OF THE INVENTION

Accordingly, an object of the present invention is to provide a method for producing an ultrafine-crystalline alloy ribbon using a conventional winding apparatus as it is, by which the ultrafine-crystalline alloy ribbon can be efficiently wound without fracture.

SUMMARY OF THE INVENTION

When a ribbon is wound around a drum (reel) rotating at a high speed, large stress, shock, twisting, etc. are applied immediately after the start of winding, so that the brittleness of the ribbon becomes a large obstacle to winding. Further, because the speed of the ribbon is not synchronized with that of the reel in several tens of seconds after the start of winding, large stress and shock are likely applied to the ribbon suddenly, so that the ribbon is required to have sufficient toughness and shock resistance. As a result of intensive research in view of such circumstances, the inventors have found that with a reduced ratio of ultrafine crystal grains in an amorphous matrix before the start of winding, the ribbon is provided with sufficient toughness and shock resistance, solving the problems of fracture, etc. at the start of winding. The present invention has been completed based on such finding.

Thus, the method of the present invention for producing an ultrafine-crystalline alloy ribbon having a structure in which ultrafine crystal grains having an average grain size of 1-30 nm are dispersed at a ratio of 5-30% by volume in an amorphous matrix, comprises the steps of ejecting an alloy melt onto a rotating cooling roll to quench it;

forming a ribbon having such toughness that it is not fractured when bent to a bending radius of 1 mm or less, before the start of winding around a reel; and changing the forming conditions of the ultrafine-crystalline alloy ribbon after the start of winding around a reel, to obtain a structure in which ultrafine crystal grains having an average grain size of 1-30 nm are dispersed at a ratio of 5-30% by volume in an amorphous matrix.

The ribbon before the start of winding around a reel preferably has a structure, in which ultrafine crystal grains having an average grain size of 0-20 nm are dispersed at a ratio of 0-4% by volume in an amorphous matrix.

One example of changing the forming conditions of the ultrafine-crystalline alloy ribbon is to make the thickness of the ultrafine-crystalline alloy ribbon 2 μm or more smaller before the start of winding than a target thickness after the start of winding, and increase the amount of a paddle on the cooling roll after the start of winding, thereby making the thickness of the ultrafine-crystalline alloy ribbon equal to the target thickness. Methods for increasing the amount of a paddle include (a) a method of increasing a gap between an alloy-melt-ejecting nozzle and a cooling roll, (b) a method of increasing an alloy-melt-ejecting pressure, (c) a method of decreasing a peripheral speed of a cooling roll, and (d) combinations of these methods.

Another example of changing the forming conditions of the ultrafine-crystalline alloy ribbon is to make a temperature of stripping the ultrafine-crystalline alloy ribbon from the cooling roll higher after the start of winding than before the start of winding. A preferable method of elevating a stripping temperature includes a method of shifting a position of stripping the ultrafine-crystalline alloy ribbon from the downstream side of the roll to the upstream side (closer to the nozzle).

The preferred composition of an alloy melt used for the production of the ultrafine-crystalline alloy ribbon is represented by the general formula of $Fe_{100-x-y-z}A_xB_yX_z$, wherein A is Cu and/or Au, X is at least one element selected from the group consisting of Si, S, C, P, Al, Ge, Ga and Be, and x, y and z are numbers (atomic %) meeting the conditions of $0<x\leq5$, $4\leq y\leq22$, $0\leq z\leq10$, and $x+y+z\leq25$.

A fine-crystalline, soft-magnetic alloy ribbon obtained by heat-treating the above ultrafine-crystalline alloy ribbon has a structure in which fine crystal grains having an average grain size of 60 nm or less are dispersed at a ratio of 30% or more by volume in an amorphous matrix, thereby having a saturation magnetic flux density of 1.7 T or more and coercivity of 24 A/m or less. Various magnetic devices can be formed by the above fine-crystalline, soft-magnetic alloy ribbon.

BRIEF DESCRIPTION OF THE DRAWINGS

FIG. 1 is a schematic view showing a bending test method.

DESCRIPTION OF THE PREFERRED EMBODIMENTS

The ultrafine-crystalline alloy ribbon is obtained from an Fe-based alloy melt by a liquid-quenching method, and can be turned to a fine-crystalline, soft-magnetic alloy ribbon having excellent soft-magnetic properties by heat treatment. The production method of the present invention is characterized by forming a ribbon under such conditions that it has a structure providing high toughness before the start of winding, and changing the ribbon-forming conditions after the start of winding, so that the resultant ribbon has a structure providing excellent soft-magnetic properties. As long as such structural change occurs, the composition of the Fe-based alloy is not restricted.

[1] Production Method of Ultrafine-Crystalline Alloy Ribbon (1) Alloy Melt

As long as the alloy melt has such a composition as to have a high-toughness structure before the start of winding and a structure exhibiting excellent soft-magnetic properties after the start of winding, the alloy melt is not particularly restricted, but it preferably has a composition represented, for example, by $Fe_{100-x-y-z}A_xB_yX_z$, wherein A is Cu and/or Au, X is at least one element selected from the group consisting of Si, S, C, P, Al, Ge, Ga and Be, and x, y and z are numbers (atomic %) meeting the conditions of $0<x\leq5$, $4\leq y\leq22$, $0\leq z\leq10$, and $x+y+z\leq25$. The saturation magnetic flux density Bs of a fine-crystalline, soft-magnetic alloy ribbon obtained by the heat treatment of the ultrafine-crystalline alloy ribbon is 1.74 T or more in the case of $0.5\leq x\leq2$, $10\leq y\leq20$, and $1\leq z\leq9$, 1.78 T or more in the case of $1.0\leq x\leq1.8$, $10\leq y\leq18$, and $2\leq z\leq8$, and 1.8 T or more in the case of $1.2\leq x\leq1.6$, $10\leq y\leq16$, and $3\leq z\leq7$.

Taking for example a case where Cu is used as the element A in the above composition formula, the production method of the present invention will be explained in detail below, of course without intention of restricting the present invention thereto.

(2) Quenching of Melt

The alloy melt can be quenched by a single roll method. The melt temperature is preferably higher than the melting point of the alloy by 50-300° C. For example, when a ribbon as thick as several tens of micrometers in which ultrafine crystal grains are precipitated is produced, a melt at the order of 1300° C. is preferably ejected from a nozzle onto a cooling roll. An atmosphere in the single roll method is air or an inert gas (Ar, nitrogen, etc.) when the alloy does not contain an active metal, or an inert gas (Ar, He, nitrogen, etc.) or vacuum when it contains an active metal. To form an oxide layer on the surface, the melt is quenched preferably in an oxygen-containing atmosphere (for example, air).

(3) Winding (a) Before Start of Winding

Because the ribbon is likely subject to large stress, shock, twisting, etc. during winding, it should have enough toughness and shock resistance to be wound around a reel without fracture. However, if the ultrafine-crystalline alloy ribbon contains too much ultrafine crystal grains formed in an amorphous matrix, its toughness is insufficient for satisfactory winding, resulting in troubles such as fracture, etc.

Ultrafine crystal grains are precipitated from clusters (regular lattices of several nanometers) formed by the diffusion and aggregation of Cu atoms during liquid quenching as nuclei, and their amount is correlated with a cooling speed. A higher cooling speed makes an amorphous phase more stable before the solubility of Cu reaches oversaturation, resulting in a low number density (numbers per a unit area) of ultrafine crystal grains, not so different from usual amorphous alloys. On the other hand, a lower cooling speed provides a higher number density of ultrafine crystal grains, resulting in high hardness due to precipitation hardening, thus providing a low-toughness, easily fracturable ribbon. Thus, the cooling speed of the alloy melt is high for a predetermined period of time (for example, about 20 seconds) before the start of winding, to suppress the precipitation of ultrafine crystal grains, thereby providing high toughness.

To determine the timing of winding the ultrafine-crystalline alloy ribbon without fracture at a production site in a short period of time, it is preferable to evaluate the bending characteristics of the ultrafine-crystalline alloy ribbon at a bending radius 1 mm or less, as characteristics corresponding to the toughness of the ribbon. If fracture does not occur when a ribbon 1 is wound around a round rod 2 having a diameter D of 2 mm as shown in FIG. 1, it may be the that the ultrafine-crystalline alloy ribbon has satisfactory bending characteristics. No fracture occurs preferably when wound around a round rod 2 having a diameter D of 1 mm, more preferably when wound around a round rod 2 having a diameter D of 0.5 mm, and most preferably when completely bent. If the ribbon were not fractured in 90% or more of its entire width, winding would be sufficiently possible. Accordingly, the term "without fracture" used herein means that fracture does not occur to such an extent that safe winding is secured.

The bending test method can be conducted, for example, by holding a ribbon 1 with a hand at a position 3 sufficiently separate from a round rod 2, inserting the round rod 2 into a ring-shaped ribbon 1, and moving the round rod 2 in a direction away from the position 3, such that the round rod 2 comes into close contact with the ribbon 1. As long as the bending radius of the ribbon 1 is 1 mm, the position 3 at which the ribbon 1 is held is not restricted, and a center angle $\alpha$ of the ribbon 1 at the position 3 may be generally within 30°. The round rod may be made of stainless steel, aluminum, etc.

Analysis has revealed that the ultrafine-crystalline alloy ribbon having satisfactory bending characteristics (windable around a reel without fracture) has a structure in which the volume ratio of ultrafine crystal grains having an average grain size of 0-20 nm is 0-4% by volume. When the volume ratio of ultrafine crystal grains is 0-4% by volume, the ribbon has sufficient strength and toughness, thereby being stably windable without fracture under winding tension, like amorphous alloys. The volume ratio of ultrafine crystal grains before the start of winding is preferably 0-3% by volume, more preferably 0-2% by volume. The average grain size of such ultrafine crystal grains is generally 0-20 nm, preferably 0-10 nm, more preferably 0-5 nm, most preferably 0-2 nm.

(b) After Start of Winding

The winding of the ribbon around the reel can be conducted, for example, by adhering an end of the ribbon to an adhesive tape, etc. attached to a reel surface. Once wound around a reel, the alloy ribbon would not fly in the air even by blowing a stripping gas, so that fracture-causing twisting, etc. can be suppressed, surely enabling winding without fracture. Thereafter, the ribbon is made thicker, for example, by expanding the gap between the nozzle and the roll, to reduce a cooling speed of a paddle, thereby increasing the volume ratio of ultrafine crystal grains, and thus forming a ribbon having a structure in which 5-30% by volume of ultrafine crystal grains having an average grain size of 1-30 nm are dispersed in an amorphous matrix. Though the ribbon having a structure in which 5-30% by volume of ultrafine crystal grains are dispersed is more brittle than the ribbon before the start of winding, a winding operation can be continued without fracture, because the ribbon is already being wound around the reel.

A ribbon portion formed before the start of winding, which does not have a structure in which ultrafine crystal grains having an average grain size of 1-30 nm are dispersed at a ratio of 5-30% by volume in an amorphous matrix, is useless. Further, even though the conditions were changed to form a ribbon having the above structure after the start of winding, such ribbon would not be obtained immediately, similarly resulting in a useless ribbon formed in a period immediately after the start of winding and before the formation of the ribbon having the above structure. Accordingly, a period before the start of winding, and a period after the start of winding and before the formation of the above structure are preferably as short as possible.

Thus, the method of the present invention stably winding a high-toughness ribbon by suppressing the precipitation of ultrafine crystal grains for higher toughness before the start of winding, and increasing the amount of precipitated ultrafine crystal grains for a desired structure after the start of winding, is applicable to any alloy ribbons, as long as they have compositions forming ultrafine crystal grains by a rapid quenching method.

(4) Control of Peripheral Speed of Cooling Roll

Because the volume ratio of ultrafine crystal grains is closely correlated with the cooling speed and time of the alloy ribbon, the adjustment of a peripheral speed of the cooling roll is one of important means for controlling the volume ratio of ultrafine crystal grains. A higher peripheral speed of a roll generally provides a lower volume ratio of ultrafine crystal grains, while a lower peripheral speed provides a higher volume ratio. The peripheral speed of the roll after the start of winding is preferably 15-50 m/s, more preferably 20-40 m/s, most preferably 20-30 m/s. To conduct continuously and smoothly a step of forming a high-toughness ribbon before the start of winding, and a step of forming a ribbon having 5-30% by volume of ultrafine crystal grains after the start of winding, the peripheral speed difference of the roll before and after the start of winding the ribbon (the peripheral speed of the roll before the start of winding—the peripheral speed of the roll after the start of winding) is preferably about 2-5 m/s.

Materials for the roll are suitably pure copper, or copper alloys such as Cu—Be, Cu—Cr, Cu—Zr, Cu—Zr—Cr, etc. having high thermal conductivity. In the case of mass production or the production of a thick and/or wide ribbon, a water-cooled roll is preferable. Because the water-cooling of the roll affects the volume ratio of ultrafine crystal grains, the roll should have a constant cooling capacity, which may be called "cooling speed," from the start to end of casting. Because the cooling capacity of the roll is correlated with the temperature of cooling water, the cooling water should be kept at a predetermined temperature.

(5) Adjustment of Gap Between Nozzle and Cooling Roll

An alloy melt is ejected onto a rotating cooling roll at a high speed in a roll-quenching method. The melt is not immediately solidified on the roll, but a paddle having certain viscosity and surface tension is kept for about $10^{-8}$-$10^{-6}$ seconds just below the nozzle. A larger amount of a paddle forms a thicker ribbon, resulting in a larger volume ratio of ultrafine crystal grains. Methods for increasing the amount of a paddle after the start of winding include a method of expanding the gap between the nozzle and the roll (gap adjustment method), a method of decreasing a peripheral speed of the roll, and a method of increasing the ejection pressure or the weight of the melt. In the method of increasing the ejection pressure or the weight of the melt, however, precise control is difficult, because the amount of the paddle changes depending on the amount of a remaining melt, the temperature, etc. In the case of gap adjustment, however, precise control is relatively easy by always feedbacking the monitored distance between the nozzle and the roll. Accordingly, the amount of ultrafine crystal grains precipitated is preferably controlled by gap adjustment.

Specifically, it has been found that when a ribbon having a thickness 2 μm or more smaller than a target thickness is formed, the target thickness being the thickness of a ribbon having a structure in which ultrafine crystal grains having an average grain size of 1-30 nm are dispersed at a ratio of 5-30% by volume in an amorphous matrix, the volume ratio of ultrafine crystal grains having an average grain size of 0-20 nm can be made 0-4% by volume. When the target thickness of the ribbon is about 15-30 μm, the control of the paddle for providing the resultant ribbon with a thickness 2 μm or more smaller than the target thickness can produce a ribbon having a structure in which ultrafine crystal grains having an average grain size of 0-20 nm are dispersed at a ratio of 0-4% by volume. The value of (the target thickness—the thickness of the ribbon before the start of winding) is preferably 2-5 μm, more preferably 2-3 μm, though variable depending on the composition.

In the case of gap adjustment, too large a gap likely provides a ribbon with a cross section shape having a thick center portion and thin edge portions, so that the volume ratio of ultrafine crystal grains tends to be higher in a transverse center portion than in edge portions by the cooling speed difference. Accordingly, the upper limit of the gap is preferably 300 μm, more preferably 250 μm, most preferably 220 μm. On the other hand, a narrow gap makes the ribbon thinner in a transverse center portion than in edge portions, resulting in the suppressed thickness difference and an easily collapsible paddle. Accordingly, the lower limit of the gap is preferably 100 μm, more preferably 130 μm, most preferably 150 μm. Though the change of a slit shape can average a distribution of the volume ratio of ultrafine crystal grains in a transverse direction, a narrow slit in a center portion tends to be clogged by the melt. Accordingly, a ratio of the slit width in edge portions to the slit width in a center portion is desirably 2 times or less.

(6) Control of Stripping Temperature and Stripping Position

A high stripping temperature of the ribbon after the start of winding increases the volume ratio of ultrafine crystal grains. The quenched ribbon can be stripped from the cooling roll by blowing an inert gas (nitrogen, etc.) into a gap between the ribbon and the cooling roll. The stripping temperature of the ribbon can be adjusted by changing the position of a nozzle blowing an inert gas (stripping position). Generally, a stripping position on the downstream side of the roll (distant from the melt-ejecting nozzle) provides a low volume ratio of ultrafine crystal grains by progressed quenching, while a stripping position on the upstream side (near the melt-ejecting nozzle) provides a high volume ratio of ultrafine crystal grains by less quenching. Accordingly, to elevate the stripping temperature of the ribbon, the stripping position is neared to the melt-ejecting nozzle after the start of winding.

To obtain a structure containing ultrafine crystal grains having an average grain size of 1-30 nm at a ratio of 5-30% by volume, the stripping temperature of the ribbon is preferably 170-350° C., more preferably 200-340° C., most preferably 250-330° C. When the stripping temperature is higher than 350° C., too much crystallization with Cu proceeds, a high-B-concentration amorphous layer is not formed near the surface, failing to obtain high toughness. On the other hand, when the stripping temperature is lower than 170° C., quenching proceeds to make the alloy structure substantially amorphous. Thus, before the start of winding, the stripping temperature is controlled to 160° C. or lower by adjusting the stripping position to strip a near amorphous ribbon. After the start of winding, the stripping temperature is controlled to 170-350° C. by shifting the stripping position toward the upstream side (closer to the melt-ejecting nozzle), thereby providing a ribbon with a structure containing 5-30% by volume of ultrafine crystal grains. The stripping temperature of the ribbon before the start of winding is preferably 150° C. or lower, more preferably 120° C. or lower. It should be noted that the control of the stripping position needs a more difficult technique than the above control of gap adjustment and the peripheral speed of the roll.

[2] Ultrafine-Crystalline Alloy Ribbon

Among the ultrafine-crystalline alloy ribbon produced by the method of the present invention, a portion formed after the start of winding has a structure in which ultrafine crystal grains having an average grain size of 1-30 nm are dispersed at a ratio of 5-30% by volume in an amorphous matrix. When the ultrafine crystal grains have an average grain size of more than 30 nm, coarse crystal grains are formed by a heat treatment, failing to obtain satisfactory soft-magnetic properties. On the other hand, when the ultrafine crystal grains have an average grain size of less than 1 nm (completely or substantially amorphous), coarse crystal grains are rather easily formed by a heat treatment. The lower limit of the average grain size of ultrafine crystal grains is preferably 3 nm, more preferably 5 nm. Accordingly, the average grain size of ultrafine crystal grains is generally 1-30 nm, preferably 3-25 nm, more preferably 5-20 nm, most preferably 5-15 nm. The volume ratio of such ultrafine crystal grains is generally 5-30%, preferably 6-25%, more preferably 8-25%, most preferably 10-25%.

With an average distance (between centers of gravity) of 50 nm or less between ultrafine crystal grains, the magnetic anisotropies of fine crystal grains are preferably averaged, resulting in a low effective crystal magnetic anisotropy. The average distance of more than 50 nm provides a small effect of averaging magnetic anisotropy, resulting in a high effective crystal magnetic anisotropy, and thus poor soft-magnetic properties.

[3] Heat Treatment Method

Heat treatments conducted on the ultrafine-crystalline alloy ribbon include a high-temperature, high-speed heat treatment by which the ribbon is heated at a temperature-elevating speed of 100° C./minute or more to the highest temperature of $(T_{X2}-50)$° C. or higher, wherein $T_{X2}$ is the precipitation temperature of a compound, and kept at the highest temperature for 1 hour or less, and a low-temperature, long-time heat treatment by which the ribbon is kept at the highest temperature of about 350° C. or higher and lower than 430° C. for 1 hour or more.

(1) High-Temperature, Short-Time Heat Treatment

In the high-temperature, short-time heat treatment, an average speed of elevating the temperature to the highest temperature is preferably 100° C./minute or more. Particularly because the temperature-elevating speed in a high temperature range of 300° C. or higher in which grain growth starts has large influence on magnetic properties, the average temperature-elevating speed at 300° C. or higher is preferably 100° C./minute or more for a short period of time. The highest temperature in the heat treatment is preferably ($T_{X2}$−50)° C. or higher, wherein $T_{X2}$ is the precipitation temperature of a compound, specifically 430° C. or higher. Lower than 430° C. provides insufficient precipitation and growth of fine crystal grains. The upper limit of the highest temperature is preferably 500° C. ($T_{X2}$). The highest-temperature-keeping time of more than 1 hour would not substantially change fine crystallization, resulting in only low productivity. Accordingly, the highest-temperature-keeping time is preferably 30 minutes or less, more preferably 20 minutes or less, most preferably 15 minutes or less. Even such high-temperature heat treatment can suppress the growth of crystal grains and the formation of compounds as long as it is for a short period of time, resulting in low coercivity, an improved magnetic flux density in a low magnetic field, and low hysteresis loss.

(2) Low-Temperature, Long-Time Heat Treatment

In the low-temperature, long-time heat treatment, the ribbon is kept at the highest temperature of about 350° C. or higher and lower than 430° C. for 1 hour or more. From the aspect of mass productivity, the highest-temperature-keeping time is preferably 24 hours or less, more preferably 4 hours or less. To suppress increase in coercivity, the average temperature-elevating speed is preferably 0.1-200° C./minute, more preferably 0.1-100° C./minute. This heat treatment produces a fine-crystalline, soft-magnetic alloy ribbon having high squareness. This heat treatment can be conducted by the existing apparatus with excellent mass productivity.

(3) Heat Treatment Atmosphere

Though it may be air, the heat treatment atmosphere is preferably a mixed gas of an inert gas such as nitrogen, Ar, helium, etc. with oxygen. To form an oxide layer having a desired layer structure by the diffusion of Si, Fe, B and Cu toward the surface side, the concentration of oxygen in the heat treatment atmosphere is preferably 6-18%, more preferably 8-15%, most preferably 9-13%. The dew point of the heat treatment atmosphere is preferably −30° C. or lower, more preferably −60° C. or lower.

(4) Heat Treatment in Magnetic Field

To provide the alloy ribbon with good induction magnetic anisotropy by a heat treatment in a magnetic field, a magnetic field having sufficient intensity to saturate the soft-magnetic alloy is preferably applied while the heat treatment temperature is 200° C. or higher (preferably 20 minutes or more), at least during temperature elevation, while the highest temperature is kept, or during cooling. Though variable depending on the shape of the alloy ribbon, the intensity of a magnetic field is preferably 8 kA/m or more, regardless of whether it is applied in a transverse direction of the ribbon (height direction in the case of a toroidal core) or in a longitudinal direction of the ribbon (circumferential direction in the case of a toroidal core). The magnetic field may be a DC magnetic field, an AC magnetic field, or a pulse magnetic field. The heat treatment in a magnetic field provides the fine-crystalline, soft-magnetic alloy ribbon with a DC hysteresis loop having a high or low squareness ratio. When the heat treatment is conducted without a magnetic field, the fine-crystalline, soft-magnetic alloy ribbon has a DC hysteresis loop with a medium squareness ratio.

[4] Structure of Fine-Crystalline, Soft-Magnetic Alloy Ribbon

The heat-treated alloy ribbon (fine-crystalline, soft-magnetic alloy ribbon) has a structure in which fine crystal grains having a body-centered cubic (bcc) structure and an average grain size of 60 nm or less are dispersed at a volume ratio of 30% or more in an amorphous phase. When the average grain size of fine crystal grains exceeds 60 nm, the ribbon has decreased soft-magnetic properties. When the volume ratio of fine crystal grains is less than 30%, the ribbon has too much an amorphous phase, having a low saturation magnetic flux density. After the heat treatment, the average grain size of fine crystal grains is preferably 40 nm or less, more preferably 30 nm or less. The lower limit of the average grain size of fine crystal grains is generally 12 nm, preferably 15 nm, more preferably 18 nm. After the heat treatment, the volume ratio of fine crystal grains is preferably 50% or more, more preferably 60% or more. With the average grain size of 60 nm or less and the volume ratio of 30% or more, the alloy ribbon has lower magnetostriction than those of Fe-based amorphous alloys, together with excellent soft-magnetic properties. Though an Fe-based amorphous alloy ribbon having the same composition has relatively large magnetostriction by a magnetic volume effect, the fine-crystalline, soft-magnetic alloy in which bcc-Fe-based, fine crystal grains are dispersed has much smaller magnetostriction due to the magnetic volume effect, together with a large noise-reducing effect.

[5] Surface Treatment

The fine-crystalline, soft-magnetic alloy ribbon may be provided with an oxide layer of $SiO_2$, MgO, $Al_2O_3$, etc. if necessary. A surface treatment during the heat treatment step provides high bonding strength of oxides. Magnetic cores of the fine-crystalline, soft-magnetic alloy ribbons may be impregnated with resins, if necessary.

[6] Examples of Magnetic Alloys

A magnetic alloy, to which the present invention is applicable, has a composition represented by the general formula of $Fe_{100-x-y-z}A_xB_yX_z$, wherein A is Cu and/or Au, X is at least one element selected from the group consisting of Si, S, C, P, Al, Ge, Ga and Be, and x, y and z are numbers (atomic %) meeting the conditions of $0<x\leq5$, $4\leq y\leq22$, $0\leq z\leq10$, and $x+y+z\leq25$. Of course, the above composition may contain inevitable impurities. When a saturation magnetic flux density Bs of 1.7 T or more is needed, its structure should have fine bcc-Fe crystals (nano crystals), needing a high Fe content. Specifically, the Fe content is 75 atomic % or more, preferably 77 atomic % or more, more preferably 78 atomic % or more.

To have good soft-magnetic properties, specifically both coercivity of 24 A/m or less, preferably 12 A/m or less, and a saturation magnetic flux density Bs of 1.7 T or more, this alloy has a below-described basic composition of Fe—B stably providing an amorphous phase even with a high Fe content, to which nuclei-forming elements A (Cu and/or Au) insoluble in Fe are added. Specifically, Cu and/or Au insoluble in Fe are added to an Fe—B alloy containing 88 atomic % or less of Fe, in which a main amorphous phase is stably formed, to precipitate ultrafine crystal grains. The ultrafine crystal grains uniformly grow by a subsequent heat treatment.

When the amount x of the element A is too small, the precipitation of fine crystal grains is difficult. When it exceeds 5 atomic %, a mostly amorphous ribbon formed by quenching becomes brittle. From the aspect of cost, the element A is preferably Cu. More than 3 atomic % of Cu tends to deteriorate soft-magnetic properties. Accordingly, the amount x of Cu is generally more than 0 atomic % and 5 atomic % or less, preferably 0.5-2 atomic %, more preferably 1.0-1.8 atomic %, most preferably 1.2-1.6 atomic %, particularly 1.3-1.4 atomic %.

B (boron) is an element promoting the formation of an amorphous phase. When B is less than 4 atomic %, the formation of an amorphous phase is difficult. To obtain a mostly amorphous structure, B is preferably 10 atomic % or more. On the other hand, when B is more than 22 atomic %, the resultant alloy ribbon has a saturation magnetic flux density of less than 1.7 T. Accordingly, the amount y of B is generally 4-22 atomic %, preferably 10-20 atomic %, more preferably 10-18 atomic %, most preferably 10-16 atomic %, particularly 12-14 atomic %.

The element X is at least one element selected from Si, S, C, P, Al, Ge, Ga and Be, and Si is particularly preferable. The addition of the element X makes higher the precipitation temperature of Fe—B or Fe—P (when P is added) having large crystal magnetic anisotropy, enabling a higher heat treatment temperature. A high-temperature heat treatment increases the percentage of fine crystal grains, increasing Bs, improving the squareness of a B-H curve, and suppressing the deterioration or discoloration of a ribbon surface. Though the lower limit of the amount z of the element X may be 0 atomic %, 1 atomic % or more of the element X provides the ribbon with a surface oxide layer of the element X, sufficiently preventing oxidation inside. When the amount z of the element X is more than 10 atomic %, Bs is less than 1.7 T. Accordingly, the amount z of the element X is generally 0-10 atomic %, preferably 1-9 atomic %, more preferably 2-8 atomic %, most preferably 3-7 atomic %, particularly 3.5-6 atomic %.

The saturation magnetic flux density of the ultrafine-crystalline alloy ribbon is 1.74 T or more in a region of $0.5 \le x \le 2$, $10 \le y \le 20$, and $1 \le z \le 9$, 1.78 T or more in a region of $1.0 \le x \le 1.8$, $10 \le y \le 18$, and $2 \le z \le 8$, and 1.8 T or more in a region of $1.2 \le x \le 1.6$, $10 \le y \le 16$, and $3 \le z \le 7$.

Among the element X, P is an element improving the formability of an amorphous phase, suppressing the growth of fine crystal grains and the segregation of B to an oxide layer. Therefore, P is preferable for achieving high toughness, high Bs and good soft-magnetic properties. With P contained, breakage does not occur, for example, when the alloy ribbon is wound around a round rod having a radius of 1 mm. This effect is obtained regardless of the temperature-elevating speed of a nano-crystallization heat treatment. As the element X, other elements S, C, Al, Ge, Ga and Be may also be used. With these elements contained, the magnetostriction and soft-magnetic properties of the ribbon can be adjusted. The element X is easily segregated to the surface, effective for forming a strong oxide layer.

Part of Fe may be substituted by at least one element E selected from the group consisting of Ni, Mn, Co, V, Cr, Ti, Zr, Nb, Mo, Hf, Ta and W. The amount of the element E is preferably 0.01-10 atomic %, more preferably 0.01-3 atomic %, most preferably 0.01-1.5 atomic %. Among the element E, Ni, Mn, Co, V and Cr have an effect of shifting a high-B-concentration region toward the surface side, forming a near-matrix structure in a region close to the surface, thereby improving the soft-magnetic properties (permeability, coercivity, etc.) of the soft-magnetic alloy ribbon. Also, they are predominantly contained in the amorphous phase remaining after the heat treatment together with the element A and metalloid elements such as B, Si, etc., suppressing the growth of high-Fe-content, fine crystal grains, reducing the average particle size of fine crystal grains, and thus improving saturation magnetic flux density Bs and soft magnetic properties.

Particularly when part of Fe is substituted by Ni or Co, which is soluble in Fe together with the element A, the maximum amount of the element A added increases, so that the crystal structure becomes finer, providing improved soft magnetic properties. The amount of Ni is preferably 0.1-2 atomic %, more preferably 0.5-1 atomic %. Less than 0.1 atomic % of Ni provides an insufficient effect of improving handlability (cuttability and windability), while more than 2 atomic % of Ni lowers Bs, $B_{80}$ and Hc. The amount of Co is also preferably 0.1-2 atomic %, more preferably 0.5-1 atomic %.

Because Ti, Zr, Nb, Mo, Hf, Ta and W are also predominantly contained together with the element A and metalloid elements in the amorphous phase remaining after the heat treatment, they contribute to the improvement of a saturation magnetic flux density Bs and soft magnetic properties. Too much addition of these elements having large atomic weights decreases the Fe content per a unit weight, deteriorating soft magnetic properties. The total amount of these elements is preferably 3 atomic % or less. Particularly in the case of Nb and Zr, their total amount is preferably 2.5 atomic % or less, more preferably 1.5 atomic % or less. In the case of Ta and Hf, their total amount is preferably 1.5 atomic % or less, more preferably 0.8 atomic % or less.

Part of Fe may be substituted by at least one element selected from the group consisting of Re, Y, Zn, As, Ag, In, Sn, Sb, platinum-group elements, Bi, N, O, and rare earth elements. The total amount of these elements is preferably 5 atomic % or less, more preferably 2 atomic % or less. To obtain a particularly high saturation magnetic flux density, the total amount of these elements is preferably 1.5 atomic % or less, more preferably 1.0 atomic % or less.

The present invention will be explained in more detail with Examples below without intention of restriction. In each of Examples and Comparative Examples, the stripping temperature of a ribbon, the average grain size and volume ratio of ultrafine crystal grains and fine crystal grains, and the saturation magnetic flux density and coercivity of a ribbon were measured by the following methods.

(1) Stripping Temperature of Ribbon

The temperature of a ribbon when stripped from a cooling roll by a nitrogen gas blown from a nozzle was measured by a radiation thermometer (FSV-7000E available from Apiste), and regarded as the stripping temperature of the ribbon.

(2) Average Grain Size and Volume Ratio of Ultrafine Crystal Grains and Fine Crystal Grains The average particle size of ultrafine crystal grains in a ribbon before or after the start of winding was determined by measuring the long diameters $D_L$ and short diameters $D_S$ of ultrafine crystal grains in the number of n (30 or more) arbitrarily selected from a TEM photograph of an arbitrary region of each ribbon, and averaging them by the formula of $\Sigma(D_L+D_S)/2n$. Five arbitrary straight lines each having a length Lt were drawn on the TEM photograph. The total length Lc of portions of each straight line crossing fine crystal grains was measured, and a ratio of crystal grains along each straight line ($L_L$=Lc/Lt) was calculated. This operation was repeated on five straight lines, and the resultant five $L_L$s were averaged to determine the volume ratio of ultrafine crystal grains. The volume ratio $V_L$=Vc/Vt, wherein Vc is the total volume of ultrafine crystal grains, and Vt is the volume of a sample, was approximated to $V_L \approx Lc^3/Lt^3 = L_L^3$. The same is true of the measurement of the average grain size and volume ratio of fine crystal grains in the heat-treated ribbon.

(3) Saturation Magnetic Flux Density and Coercivity of Ribbon

In any of Examples, Reference Example and Comparative Examples, each fine-crystalline, soft-magnetic alloy ribbon produced through a low-temperature, long-time heat treatment comprising heating to 410° C. in about 15 minutes, and then keeping the above temperature for 1 hour was measured by a B-H loop tracer (available from Metron, Inc.), with respect to a magnetic flux density $B_{8000}$ at 8000 A/m (substantially the same as a saturation magnetic flux density Bs), a magnetic flux density $B_{80}$ at 80 A/m, and coercivity Hc.

Example 1

An alloy melt (1300° C.) having a composition of $Fe_{bal.}Cu_{1.4}Si_4B_{14}$ (atomic %) was ejected onto a copper-alloy-made cooling roll rotating at a constant peripheral speed of 30 m/s, to form an ultrafine-crystalline alloy ribbon of 25 mm in width and about 10000 m in length under the ejection conditions shown in Table 1, and the ribbon was stripped from the roll at a temperature of 250° C. As shown in FIG. 1, this ultrafine-crystalline alloy ribbon was wound around a round rod having a diameter D of 2 mm to carry out a bending test with a bending radius of 1 mm. As a result, fracture did not occur.

Next, an end portion of an ultrafine-crystalline alloy ribbon stripped from the cooling roll and flying in the air was attached to an adhesive tape on a rotating reel, and wound around the reel (see JP 2001-191151 A), without fracture at all. This indicates that a ribbon passing the bending test with a bending radius of 1 mm can be wound around a reel without fracture.

During 20 seconds at maximum after the start of ejection and before the start of winding, the gap between the nozzle and the cooling roll was set to 180 μm. The gap was expanded to a target of 200 μm in about 10 seconds after the start of winding, and the gap was then kept constant by feedback control. Even though the gap between the nozzle and the cooling roll was expanded after the start of winding to increase the average grain size and volume ratio of ultrafine crystal grains, the winding of the ribbon around the reel could be continued normally. To make up for decrease in the amount of the melt remaining in a crucible, the ejection pressure was increased from 223 g/cm$^2$ to 342 g/cm$^2$ continuously in proportion to the ejection time. The ejection pressure increase was conducted similarly in Examples, Reference Example and Comparative Examples below.

The thickness of the ribbon and the average grain size and volume ratio of ultrafine crystal grains before and after the start of winding, and the coercivity of the heat-treated ribbon are shown in Table 1.

TABLE 1

| | Ejection Conditions | | | |
|---|---|---|---|---|
| Timing of Measurement | Gap (μm) | Peripheral Speed (m/s) | Ejection Pressure (g/cm$^2$) | |
| Before start of winding | 180 | 30 | 223 | |
| After start of winding | 200 | 30 | 342 | |
| Timing of Measurement | Thickness (μm) | Average Grain Size (nm) | Volume Ratio (%) | Coercivity (A/m) |
| Before start of winding | 18.7 | 1 | 1 | — |
| After start of winding | 20.8 | 10 | 22 | 7 |

Reference Example 1

Using the same alloy melt as in Example 1, a ribbon was produced in the same manner as in Example 1 except that the gap was not substantially changed as shown in Table 2. The same bending test as in Example 1 with a bending radius of 1 mm indicated that the ribbon was not fractured. A ribbon stripped from the cooling roll and randomly flying in the air could be wound around a reel without fracture. The thickness of the ribbon and the average grain size and volume ratio of ultrafine crystal grains before and after the start of winding, and the coercivity of the heat-treated ribbon are shown in Table 2.

TABLE 2

| | Ejection Conditions | | | |
|---|---|---|---|---|
| Timing of Measurement | Gap (μm) | Peripheral Speed (m/s) | Ejection Pressure (g/cm$^2$) | |
| Before start of winding | 180 | 30 | 225 | |
| After start of winding | 175 | 30 | 320 | |
| Timing of Measurement | Thickness (μm) | Average Grain Size (nm) | Volume Ratio (%) | Coercivity (A/m) |
| Before start of winding | 18.9 | 1 | 1 | — |
| After start of winding | 18.9 | 1 | 2 | 15 |

In both of Example 1 and Reference Example 1, the ribbon stripped from the roll could be caught by the adhesive tape and normally wound around the reel, because the volume ratio of ultrafine crystal grains before the start of winding was in a range of 0-4% by volume, providing the ribbon with sufficient toughness. Both ribbons in Example 1 and Reference Example 1 had a saturation magnetic flux density $B_{8000}$ of 1.80 T. Though the ribbon of Example 1 had coercivity of 7 A/m, the ribbon of Reference Example 1 had as relatively high coercivity as 15 A/m, presumably because the gap was not changed after the start of winding in Reference Example 1, failing to obtain an ultrafine-crystalline alloy ribbon having a structure in which ultrafine crystal grains having an average grain size of 1-30 nm were dispersed at a ratio of 5-30% by volume, so that a fine-crystalline, soft-magnetic alloy ribbon having a high saturation magnetic flux density and low coercivity was not obtained even by a heat treatment.

Example 2

Using an alloy melt having a composition of $Fe_{bal.}Cu_{1.4}Si_5B_{13}$ (atomic %), a ribbon was produced in the same manner as in Example 1 except for using the ejection conditions shown in Table 3. By the same bending test with a bending radius of 1 mm as in Example 1, the ribbon was not fractured. The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 3.

TABLE 3

| | Ejection Conditions | | | |
|---|---|---|---|---|
| Timing of Measurement | Gap (μm) | Peripheral Speed (m/s) | Ejection Pressure (g/cm$^2$) | |
| Before start of winding | 150 | 27 | 224 | |
| After start of winding | 200 | 27 | 340 | |
| Timing of Measurement | Thickness (μm) | Average Grain Size (nm) | Volume Ratio (%) | Coercivity (A/m) |
| Before start of winding | 20.1 | 0 | 0 | — |
| After start of winding | 23.1 | 10 | 20 | 7 |

Example 3

Using an alloy melt having a composition of $Fe_{bal.}Cu_{1.4}Si_6B_{12}$ (atomic %), a ribbon was produced in the same manner as in Example 1 except for using the ejection conditions shown in Table 4. By the same bending test with a bending radius of 1 mm as in Example 1, the ribbon was not fractured. Even though the bending radius was changed to 0.5 mm in the above bending test, the ribbon was not fractured either. Further, even complete bending of the ribbon with bent portions closely attached to each other did not cause fracture. The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 4.

TABLE 4

| | Ejection Conditions | | |
|---|---|---|---|
| Timing of Measurement | Gap (μm) | Peripheral Speed (m/s) | Ejection Pressure (g/cm$^2$) |
| Before start of winding | 180 | 25 | 148 |
| After start of winding | 200 | 25 | 342 |

| Timing of Measurement | Thickness (μm) | Average Grain Size (nm) | Volume Ratio (%) | Coercivity (A/m) |
|---|---|---|---|---|
| Before start of winding | 21.5 | 1 | 2 | — |
| After start of winding | 24.4 | 10 | 18 | 8 |

Example 4

Using an alloy melt having a composition of $Fe_{bal.}Cu_{1.35}Si_4B_{13}$ (atomic %), a ribbon was produced in the same manner as in Example 1 except for using the ejection conditions shown in Table 5. By the same bending test with a bending radius of 1 mm as in Example 1, the ribbon was not fractured. The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 5.

TABLE 5

| | Ejection Conditions | | |
|---|---|---|---|
| Timing of Measurement | Gap (μm) | Peripheral Speed (m/s) | Ejection Pressure (g/cm$^2$) |
| Before start of winding | 170 | 27 | 170 |
| After start of winding | 200 | 27 | 341 |

| Timing of Measurement | Thickness (μm) | Average Grain Size (nm) | Volume Ratio (%) | Coercivity (A/m) |
|---|---|---|---|---|
| Before start of winding | 19.9 | 2 | 2 | — |
| After start of winding | 22.5 | 10 | 18 | 7 |

Example 5

Using an alloy melt having a composition of $Fe_{bal.}Cu_{1.35}Si_4B_{13}$ (atomic %), a ribbon of 50 mm in width and about 5000 m in length was produced in the same manner as in Example 1 except for using the ejection conditions shown in Table 6. By the same bending test with a bending radius of 1 mm as in Example 1, the ribbon was not fractured. Even though the bending radius was changed to 0.5 mm in the above bending test, the ribbon was not fractured. Further, even complete bending of the ribbon with bent portions closely attached to each other did not cause fracture.

The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 6.

TABLE 6

| | Ejection Conditions | | |
|---|---|---|---|
| Timing of Measurement | Gap (μm) | Peripheral Speed (m/s) | Ejection Pressure (g/cm$^2$) |
| Before start of winding | 170 | 29 | 165 |
| After start of winding | 200 | 29 | 344 |

| Timing of Measurement | Thickness (μm) | Average Grain Size (nm) | Volume Ratio (%) | Coercivity (A/m) |
|---|---|---|---|---|
| Before start of winding | 19.1 | 0 | 0 | — |
| After start of winding | 22.5 | 10 | 20 | 7.5 |

Example 6

Using an alloy melt having a composition of $Fe_{bal.}Cu_{1.3}Si_4B_{14}$ (atomic %), a ribbon was produced in the same manner as in Example 1 except for using the ejection conditions shown in Table 7. By the same bending test with a bending radius of 0.5 mm as in Example 3, the ribbon was not fractured. Further, even complete bending of the ribbon with bent portions closely attached to each other did not cause fracture.

The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 7.

TABLE 7

| | Ejection Conditions | | |
|---|---|---|---|
| Timing of Measurement | Gap (μm) | Peripheral Speed (m/s) | Ejection Pressure (g/cm$^2$) |
| Before start of winding | 180 | 28 | 156 |
| After start of winding | 210 | 28 | 344 |

TABLE 7-continued

| Timing of Measurement | Thickness (μm) | Average Grain Size (nm) | Volume Ratio (%) | Coercivity (A/m) |
|---|---|---|---|---|
| Before start of winding | 22.3 | 1 | 1 | — |
| After start of winding | 25.1 | 15 | 26 | 8.5 |

Example 7

Using an alloy melt having a composition of $Fe_{bal.}Cu_{1.3}Si_3B_{13}$ (atomic %), a ribbon was produced in the same manner as in Example 1 except for using the ejection conditions shown in Table 8. By the same bending test with a bending radius of 1 mm as in Example 1, the ribbon was not fractured. The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 8.

TABLE 8

| Timing of Measurement | Ejection Conditions | | |
|---|---|---|---|
| | Gap (μm) | Peripheral Speed (m/s) | Ejection Pressure (g/cm$^2$) |
| Before start of winding | 180 | 27 | 166 |
| After start of winding | 200 | 27 | 340 |

| Timing of Measurement | Thickness (μm) | Average Grain Size (nm) | Volume Ratio (%) | Coercivity (A/m) |
|---|---|---|---|---|
| Before start of winding | 19.8 | 2 | 3 | — |
| After start of winding | 22.0 | 5 | 10 | 10 |

Example 8

Using an alloy melt having a composition of $Fe_{bal.}Ni_{0.5}Cu_{1.35}Si_{3.5}B_{14}$ (atomic %), a ribbon of 50 mm in width and about 5000 m in length was produced in the same manner as in Example 1 except for using the ejection conditions shown in Table 9. By the same bending test with a bending radius of 1 mm as in Example 1, the ribbon was not fractured. The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 9.

TABLE 9

| Timing of Measurement | Ejection Conditions | | |
|---|---|---|---|
| | Gap (μm) | Peripheral Speed (m/s) | Ejection Pressure (g/cm$^2$) |
| Before start of winding | 180 | 27 | 142 |
| After start of winding | 210 | 27 | 333 |

TABLE 9-continued

| Timing of Measurement | Thickness (μm) | Average Grain Size (nm) | Volume Ratio (%) | Coercivity (A/m) |
|---|---|---|---|---|
| Before start of winding | 20.3 | 1 | 1 | — |
| After start of winding | 23.1 | 8 | 16 | 9.5 |

Example 9

Using an alloy melt having a composition of $Fe_{bal.}Ni_1Cu_{1.4}Si_4B_{14}$ (atomic %), a ribbon was produced in the same manner as in Example 1 except for using the ejection conditions shown in Table 10. By the same bending test with a bending radius of 0.5 mm as in Example 3, the ribbon was not fractured. The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 10.

TABLE 10

| Timing of Measurement | Ejection Conditions | | |
|---|---|---|---|
| | Gap (μm) | Peripheral Speed (m/s) | Ejection Pressure (g/cm$^2$) |
| Before start of winding | 180 | 30 | 223 |
| After start of winding | 200 | 30 | 332 |

| Timing of Measurement | Thickness (μm) | Average Grain Size (nm) | Volume Ratio (%) | Coercivity (A/m) |
|---|---|---|---|---|
| Before start of winding | 17.5 | 1 | 1 | — |
| After start of winding | 20.9 | 10 | 20 | 7 |

Example 10

Using an alloy melt having a composition of $Fe_{bal.}Ni_1Cu_{1.4}Si_6B_{12}$ (atomic %), a ribbon was produced in the same manner as in Example 1 except for using the ejection conditions shown in Table 11. By the same bending test with a bending radius of 0.5 mm as in Example 3, the ribbon was not fractured. Further, even complete bending of the ribbon with bent portions closely attached to each other did not cause fracture.

The ribbon stripped from the cooling roll and randomly flying in the air could be wound around the reel without fracture. Even though the gap between the nozzle and the cooling roll was expanded after the start of winding to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 11.

TABLE 11

| Timing of Measurement | Ejection Conditions: Gap (μm) | Peripheral Speed (m/s) | Ejection Pressure (g/cm$^2$) |
|---|---|---|---|
| Before start of winding | 180 | 28 | 148 |
| After start of winding | 200 | 28 | 342 |

| Timing of Measurement | Thickness (μm) | Average Grain Size (nm) | Volume Ratio (%) | Coercivity (A/m) |
|---|---|---|---|---|
| Before start of winding | 20.0 | 0 | 0 | — |
| After start of winding | 23.7 | 5 | 10 | 12 |

Comparative Examples 1-9

Using alloy melts having the compositions shown in Table 12, ribbons of 25 mm in width were produced in the same manner as in Example 1 except for using the ejection conditions shown in Table 12, such that the ribbons had target thickness from the start of ejection. By the same bending test with a bending radius of 1 mm as in Example 1, all ribbons were fractured. Among ribbons stripped from the cooling roll and randomly flying in the air, the ribbons of Comparative Examples 1-7 were fractured immediately after wound around the reel, the ribbon of Comparative Example 8 was fractured 10 seconds after the start of winding, and the ribbon of Comparative Example 9 was fractured 15 seconds after the start of winding. The thickness and windability of each ribbon and the average grain size and volume ratio of ultrafine crystal grains are shown in Table 12. It may be considered that the fracture of the ribbons of Comparative Examples 1-9 during winding was caused by ultrafine crystal grain structures before the start of winding.

TABLE 12

| No. | Alloy Composition | Ejection Conditions: Gap (μm) | Peripheral Speed (m/s) | Ejection Pressure (g/cm$^2$) |
|---|---|---|---|---|
| Com. Ex. 1 | $Fe_{bal.}Cu_{1.4}Si_4B_{14}$ | 200 | 30 | 223 |
| Com. Ex. 2 | $Fe_{bal.}Cu_{1.4}Si_5B_{13}$ | 200 | 27 | 220 |
| Com. Ex. 3 | $Fe_{bal.}Cu_{1.4}Si_6B_{12}$ | 200 | 25 | 221 |
| Com. Ex. 4 | $Fe_{bal.}Cu_{1.35}Si_4B_{13}$ | 200 | 27 | 220 |
| Com. Ex. 5 | $Fe_{bal.}Cu_{1.3}Si_4B_{14}$ | 220 | 27 | 220 |
| Com. Ex. 6 | $Fe_{bal.}Cu_{1.3}Si_3B_{13}$ | 200 | 27 | 222 |
| Com. Ex. 7 | $Fe_{bal.}Ni_{0.5}Cu_{1.35}Si_{3.5}B_{14}$ | 200 | 27 | 223 |
| Com. Ex. 8 | $Fe_{bal.}Ni_{0.5}Cu_{1.35}Si_4B_{14}$ | 210 | 27 | 224 |
| Com. Ex. 9 | $Fe_{bal.}Ni_1Cu_{1.4}Si_6B_{12}$ | 210 | 27 | 220 |

| No. | Thickness (μm) | Average Grain Size (nm) | Volume Ratio (%) | Windability |
|---|---|---|---|---|
| Com. Ex. 1 | 20.5 | 10 | 20 | Fractured immediately after winding |
| Com. Ex. 2 | 22.2 | 10 | 20 | Fractured immediately after winding |
| Com. Ex. 3 | 24.4 | 5 | 15 | Fractured immediately after winding |
| Com. Ex. 4 | 22.1 | 10 | 20 | Fractured immediately after winding |
| Com. Ex. 5 | 24.3 | 5 | 15 | Fractured immediately after winding |
| Com. Ex. 6 | 22.0 | 5 | 15 | Fractured immediately after winding |
| Com. Ex. 7 | 22.3 | 10 | 20 | Fractured immediately after winding |
| Com. Ex. 8 | 22.1 | 5 | 10 | Fractured 10 seconds after the start of winding |
| Com. Ex. 9 | 22.4 | 5 | 5 | Fractured 15 seconds after the start of winding |

Example 11

Using an alloy melt having a composition of $Fe_{bal.}Cu_{1.4}Si_5B_{13}$ (atomic %), a ribbon of 25 mm in width and about 10000 m in length was produced in the same manner as in Example 1 except for using the ejection conditions shown in Table 13. By the same bending test with a bending radius of 0.5 mm as in Example 3, the ribbon was not fractured. The ribbon stripped from the cooling roll and randomly flying in the air could be wound around the reel without fracture. In this Example, in which the peripheral speed of the roll was decreased from 30 m/s to 27 m/s without changing the gap between the nozzle and the roll after the start of winding, to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 13.

TABLE 13

| Timing of Measurement | Ejection Conditions: Gap (μm) | Peripheral Speed (m/s) | Ejection Pressure (g/cm$^2$) |
|---|---|---|---|
| Before start of winding | 200 | 30 | 224 |
| After start of winding | 200 | 27 | 340 |

| Timing of Measurement | Thickness (μm) | Average Grain Size (nm) | Volume Ratio (%) | Coercivity (A/m) |
|---|---|---|---|---|
| Before start of winding | 19.5 | 1 | 2 | — |
| After start of winding | 23.2 | 10 | 20 | 7 |

Example 12

Using an alloy melt having a composition of $Fe_{bal.}Cu_{1.4}Si_6B_{12}$ (atomic %), a ribbon was produced in the same manner as in Example 1 except for using the ejection conditions shown in Table 14. By the same bending test with a bending radius of 1 mm as in Example 1, the ribbon was not fractured. The ribbon stripped from the cooling roll and randomly flying in the air could be wound around the reel without fracture. In this Example, in which the peripheral speed of the roll was decreased from 28 m/s to 25 m/s without changing the gap between the nozzle and the roll after the start of winding, to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 14.

TABLE 14

| | Ejection Conditions | | | |
|---|---|---|---|---|
| Timing of Measurement | Gap (μm) | Peripheral Speed (m/s) | Ejection Pressure (g/cm$^2$) | |
| Before start of winding | 200 | 28 | 148 | |
| After start of winding | 200 | 25 | 342 | |
| Timing of Measurement | Thickness (μm) | Average Grain Size (nm) | Volume Ratio (%) | Coercivity (A/m) |
| Before start of winding | 22.1 | 2 | 4 | — |
| After start of winding | 24.3 | 10 | 20 | 8 |

Example 13

Using an alloy melt having a composition of $Fe_{bal.}Cu_{1.35}Si_4B_{13}$ (atomic %), a ribbon was produced in the same manner as in Example 1 except for using the ejection conditions shown in Table 15. By the same bending test with a bending radius of 0.5 mm as in Example 3, the ribbon was not fractured. The ribbon stripped from the cooling roll and randomly flying in the air could be wound around the reel without fracture. In this Example, in which the peripheral speed of the roll was decreased from 30 m/s to 26 m/s without changing the gap between the nozzle and the roll after the start of winding, to increase the average grain size and volume ratio of ultrafine crystal grains, the winding of the ribbon around the reel could be continued normally. The thickness of the ribbon and the average grain size and volume ratio of ultrafine crystal grains before and after the start of winding, and the coercivity of the heat-treated ribbon are shown in Table 15.

TABLE 15

| | Ejection Conditions | | | |
|---|---|---|---|---|
| Timing of Measurement | Gap (μm) | Peripheral Speed (m/s) | Ejection Pressure (g/cm$^2$) | |
| Before start of winding | 200 | 30 | 170 | |
| After start of winding | 200 | 26 | 340 | |
| Timing of Measurement | Thickness (μm) | Average Grain Size (nm) | Volume Ratio (%) | Coercivity (A/m) |
| Before start of winding | 19.4 | 1 | 2 | — |
| After start of winding | 22.8 | 10 | 20 | 7 |

Example 14

Ribbons were produced in the same manner as in Example 1 except for changing the compositions of alloy melts as described below. By the same bending test with a bending radius of 0.5 mm as in Example 3, all ribbons were not fractured. The ribbons stripped from the cooling roll and randomly flying in the air could be wound around the reel without fracture. Further, Even though the gap between the nozzle and the cooling roll was expanded after the start of winding to increase the average grain size and volume ratio of ultrafine crystal grains, the winding of the ribbons around the reel could be continued normally.

$Fe_{bal}Cu_{1.2}B_{18}$,
$Fe_{bal}Cu_{1.25}B_{16}$,
$Fe_{bal}Cu_{1.4}Si_6B_{11}$,
$Fe_{bal}Cu_{1.6}Si_8B_{10}$,
$Fe_{bal}Cu_{1.4}Si_2B_{12}P_2$,
$Fe_{bal}Cu_{1.5}Si_2B_{10}P_4$,
$Fe_{bal}Cu_{1.2}Si_2B_8P_8$, and
$Fe_{bal}Cu_{1.0}Au_{0.25}Si_1B_{15}$.

In any of Examples, Reference Example and Comparative Examples above, the heat-treated ribbons had structures in which fine crystal grains having an average grain size of 60 nm or less were dispersed in amorphous matrices at ratios of 30% or more by volume, thereby having saturation magnetic flux densities $B_{8000}$ of 1.7 T or more.

Effects of the Invention

Because the method of the present invention makes it possible to use a conventional winding apparatus without modifications to wind an ultrafine-crystalline alloy ribbon without fracture, the ultrafine-crystalline alloy ribbon can be stably mass-produced at a high yield. Fine-crystalline, soft-magnetic alloy ribbons and magnetic devices having high saturation magnetic flux densities and excellent soft-magnetic properties can be obtained from such ultrafine-crystalline alloy ribbons.

Because magnetic devices using the fine-crystalline, soft-magnetic alloy ribbons produced by the method of the present invention have high saturation magnetic flux densities, they are suitable for high-power applications, for which magnetic saturation is a critical problem, for example, large-current reactors such as anode reactors, choke coils for active filters, smoothing choke coils, pulse power magnetic devices used for laser power supplies and accelerators, cores for transformers, communications pulse transformers, motors and power generators, yokes, current sensors, magnetic sensors, antennas cores, electromagnetic wave-absorbing sheets, etc. Laminate of the fine-crystalline, soft-magnetic alloy ribbons may be used as step-lap or overlap wound cores for transformers.

What is claimed is:

1. A method for producing an ultrafine-crystalline alloy ribbon having a structure in which ultrafine crystal grains having an average grain size of 1-30 nm are dispersed at a ratio of 5-30% by volume in an amorphous matrix, comprising the steps of ejecting an alloy melt onto a rotating cooling roll to quench it;

forming a ribbon having such toughness that it is not fractured when bent to a bending radius of 1 mm or less, before a start of winding around a reel; and changing the forming conditions of said ribbon after the start of winding around a reel, to obtain the structure in which ultrafine crystal grains having the average grain size of 1-30 nm are dispersed at a ratio of 5-30% by volume in the amorphous matrix.

2. The method for producing a ultrafine-crystalline alloy ribbon according to claim 1, wherein the ribbon before the start of winding around a reel has a structure, in which ultrafine crystal grains having an average grain size of greater than 0 nm to 20 nm are dispersed at a ratio of 0-4% by volume in an amorphous matrix.

3. The method for producing a ultrafine-crystalline alloy ribbon according to claim 1, wherein the forming conditions of said ribbon are changed by making the amount of a paddle on said cooling roll larger after the start of winding than before the start of winding.

4. The method for producing a ultrafine-crystalline alloy ribbon according to claim 1, wherein the thickness of said ultrafine-crystalline alloy ribbon is 2 μm or more smaller before the start of winding than a target thickness after the start of winding, and made equal to said target thickness after the start of winding.

5. The method for producing a ultrafine-crystalline alloy ribbon according to claim 1, wherein the forming conditions of said ribbon are changed by making a temperature of stripping said ultrafine-crystalline alloy ribbon from said cooling roll higher after the start of winding than before the start of winding.

6. The method for producing a ultrafine-crystalline alloy ribbon according to claim 1, wherein said alloy melt has a composition represented by the general formula of $Fe_{100-x-y-z}A_xB_yX_z$, wherein A is Cu and/or Au, X is at least one element selected from the group consisting of Si, S, C, P, Al, Ge, Ga and Be, and x, y and z are numbers (atomic %) meeting the conditions of $0<x\leq5$, $4\leq y\leq22$, $0\leq z\leq10$, and $x+y+z\leq25$.

* * * * *